US011525463B2

(12) United States Patent
Sun et al.

(10) Patent No.: US 11,525,463 B2
(45) Date of Patent: Dec. 13, 2022

(54) FLUID PRESSURIZING STRUCTURE AND FAN USING SAME

(71) Applicant: ASIA VITAL COMPONENTS CO., LTD., New Taipei (TW)

(72) Inventors: Sung-Wei Sun, New Taipei (TW); Ming-Che Lee, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 286 days.

(21) Appl. No.: 16/867,569

(22) Filed: May 6, 2020

(65) Prior Publication Data

US 2021/0348625 A1 Nov. 11, 2021

(51) Int. Cl.
*F04D 29/66* (2006.01)

(52) U.S. Cl.
CPC ..... *F04D 29/667* (2013.01); *F04D 29/666* (2013.01)

(58) Field of Classification Search
CPC ..... F04D 29/666; F04D 29/667
See application file for complete search history.

(56) References Cited

U.S. PATENT DOCUMENTS

| | | | | |
|---|---|---|---|---|
| 11,326,616 | B2 * | 5/2022 | Wang | F04D 29/666 |
| 2004/0240999 | A1 | 12/2004 | Kamoshita et al. | |
| 2021/0199123 | A1 * | 7/2021 | Wang | F04D 29/34 |

FOREIGN PATENT DOCUMENTS

| | | | |
|---|---|---|---|
| CN | 203516181 | U | 4/2014 |
| CN | 207178296 | A | 4/2018 |
| CN | 209744544 | U | 12/2019 |
| EP | 2693609 | B1 | 5/2017 |
| JP | H11270493 | A | 10/1999 |
| JP | 2001032794 | A | 2/2001 |
| TW | M553896 | U | 1/2018 |
| TW | M596817 | U | 6/2020 |

OTHER PUBLICATIONS

Search Report dated Jun. 20, 2020 issued by Taiwan Intellectual Property Office/ for counterpart application No. 109113667.
Search Report dated Dec. 21, 2020 issued by China National Intellectual Property Administration for counterpart application No. 2020103291659.

* cited by examiner

*Primary Examiner* — Sabbir Hasan
(74) *Attorney, Agent, or Firm* — Demian K. Jackson; Jackson IPG PLLC

(57) ABSTRACT

A fluid pressurizing structure and fan using same are disclosed. The fluid pressurizing structure includes a hub having a plate portion located therearound. The plate portion has a first and a second surface provided with a plurality of first and second hollow protrusions, respectively. Each of the first hollow protrusions has a first fluid inlet and a first fluid outlet, and each of the second hollow protrusions has a second fluid inlet and a second fluid outlet. The first and second fluid outlets extend through the plate portion to communicate the first and second fluid inlets with the second and first surface, respectively. When the fan rotates, fluid drawn thereinto sequentially flows through the first fluid inlets and outlets and the second fluid inlets and outlets in a helical movement in cycles, and is therefore continuously pressurized, which facilitates reduced fan vibration and noise and fan motor power consumption.

20 Claims, 15 Drawing Sheets

FLUID PRESSURIZING STRUCTURE AND FAN USING SAME

FIELD OF THE INVENTION

The present invention relates to a pressurizing structure, and more particularly, to a fluid pressurizing structure and a fan using same.

BACKGROUND OF THE INVENTION

In FIGS. 1 to 3, there is shown a conventional centrifugal fluid pressurizing structure 20, which usually includes a blade-type fan wheel having a hub 22 and a plurality of blades 24, as well as a fan frame 30. When the blade-type fan wheel is driven to rotate, an external fluid is drawn into the fan frame 30 via an inlet 31 thereof and is pressurized by the blades 24. Then, the pressurized fluid flows out of the fan frame 30 via a sideward outlet 32 thereof.

In the above-described conventional centrifugal fluid pressurizing structure 20, each of the blades 24 has a fluid pressurizing section measured from a fixed end 241 of the blade 24 connected to the hub 22 to a free end 242 distal from the hub 22. The fluid pressurizing section of the blades 24 is so short that the conventional centrifugal fluid pressurizing structure 20 can provide only very limited fluid pressurizing effect.

In addition, part of the fluid having been pressurized by the conventional centrifugal fluid pressurizing structure 20 would form swirls between the blades 24 and the fan frame 30, so that some of the work done by the fan motor becomes useless while more power is consumed. Further, the swirls so formed would collide against the fan frame 30 and the blades 24 continuously to produce vibration and noise.

It is therefore tried by the inventor to develop an improved fluid pressurizing structure and a fan using same to overcome the above problems and disadvantages.

SUMMARY OF THE INVENTION

A primary object of the present invention is to provide a fluid pressurizing structure that enables the forming of an increased length of effective fluid pressurizing section on a fan, so that fluid drawn into the fan can flow in a helical movement in cycles and accordingly, be continuously pressurized.

Another object of the present invention is to provide a fan having a fluid pressurizing structure capable of eliminating the formation of swirls in the fan to thereby reduce fan vibration and noise.

A further object of the present invention is to provide a fan having a fluid pressurizing structure capable of avoiding the fan from ineffective motor rotation and high motor power consumption.

To achieve the above and other objects, the fluid pressurizing structure according to an embodiment of the present invention includes a hub having an outer circumferential surface, and a plate portion located around and connected to the hub at the outer circumferential surface. The plate portion has a first surface provided with a plurality of first hollow protrusions, an opposite second surface provided with a plurality of second hollow protrusions, and a free end. The first and the second hollow protrusions on the first and the second surface, respectively, are arrayed in a staggered arrangement. Each of the first hollow protrusions has a first fluid inlet and a first fluid outlet, and each of the second hollow protrusions has a second fluid inlet and a second fluid outlet. The first fluid outlets extend through the plate portion in a thickness direction thereof to communicate the first fluid inlets with the second surface, and the second fluid outlets extend through the plate portion in the thickness direction thereof to communicate the second fluid inlets with the first surface.

To achieve the above and other objects, the fan according to an embodiment of the present invention includes a fan frame and a fluid pressurizing structure. The fan frame is formed of a top cover and a frame body. The top cover has an inlet opening and the frame body includes a coupling seat and a sidewall. The top cover and the frame body together define a sideward outlet opening and a fluid passage between them. The coupling seat has a stator assembly disposed therearound and is externally surrounded by a plurality of through holes formed on the frame body. The sidewall is located around the fluid passage and upward vertically extended to connect the frame body to the top cover, and the fluid passage is communicable with the sideward outlet opening. The pressurizing structure includes a hub and a plate portion. The hub has a top and a peripheral wall. The top is located corresponding to the inlet opening on the top cover of the fan frame and has a shaft connected to at least one bearing received in the coupling seat on the fan frame. The peripheral wall is vertically downward extended around a periphery of the top and has a rotor assembly mounted thereon and located corresponding to the stator assembly. An outer surface of the peripheral wall defines an outer circumferential surface. The plate portion is located around the hub and connected thereto at the outer circumferential surface. The plate portion has a first surface provided with a plurality of first hollow protrusions, an opposite second surface provided with a plurality of second hollow protrusions, and a free end. The first and the second hollow protrusions on the first and the second surface, respectively, are arrayed in a staggered arrangement. Each of the first hollow protrusions has a first fluid inlet and a first fluid outlet, and each of the second hollow protrusions has a second fluid inlet and a second fluid outlet. The first fluid outlets extend through the plate portion in a thickness direction thereof to communicate the first fluid inlets with the second surface, and the second fluid outlets extend through the plate portion in the thickness direction thereof to communicate the second fluid inlets with the first surface.

With the above arrangements, fluid drawn into a fan is continuously pressurized to enable reduced fan vibration and noise, as well as reduced fan motor power consumption.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and by referring to the accompanying drawings.

Figure 1:
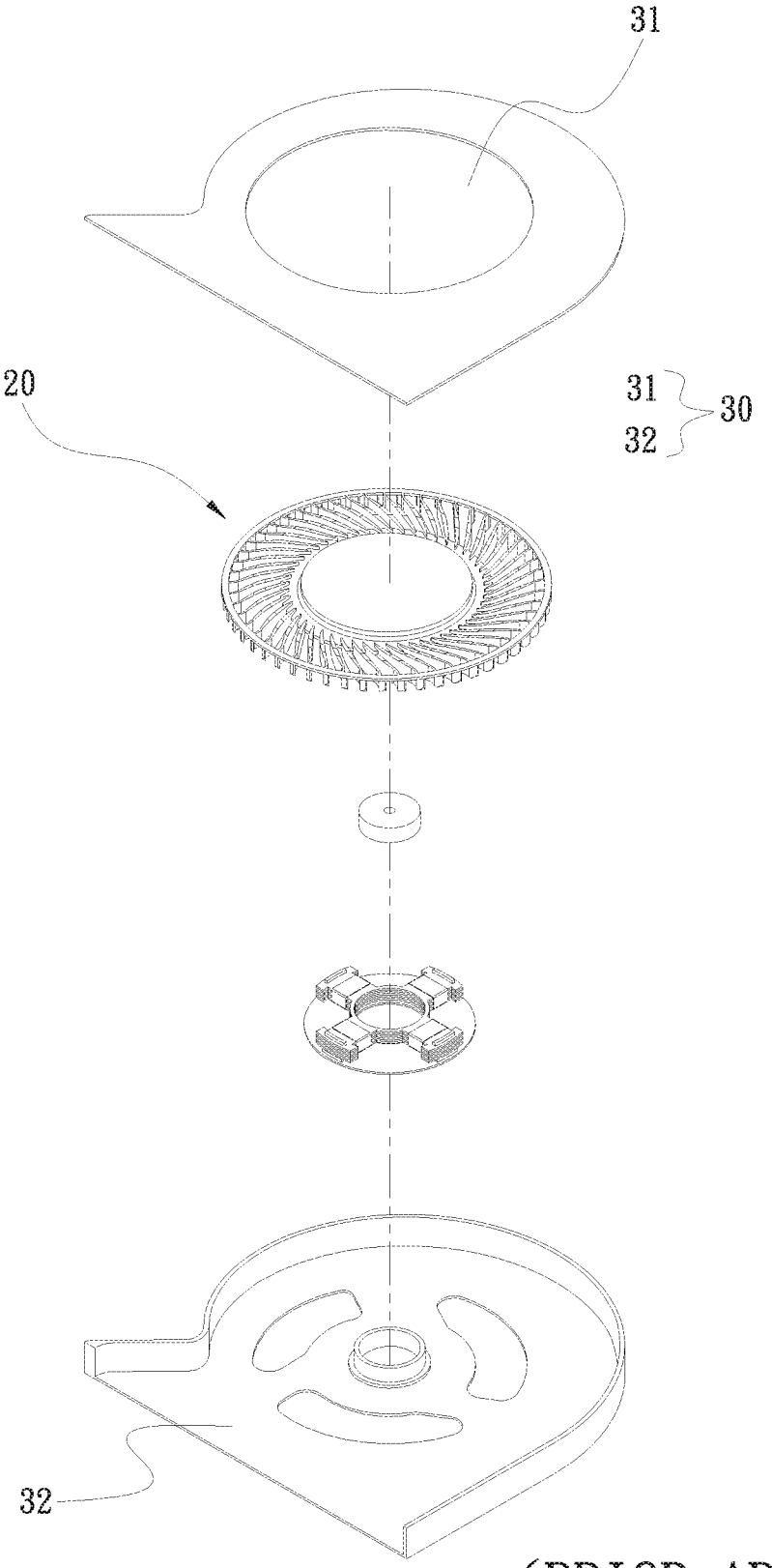
(PRIOR ART) Fig. 1
FIG. 1 is an exploded perspective view showing a prior art fan frame and a conventional fluid pressurizing structure.
Figure 2:
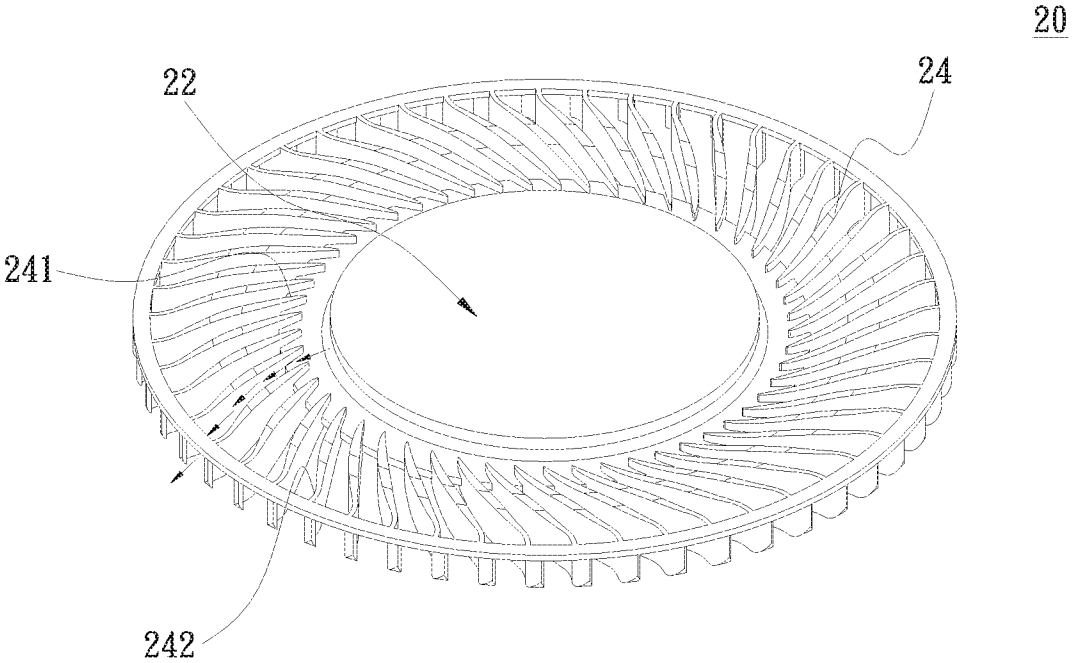
(PRIOR ART) Fig. 2
FIG. 2 is a perspective view of the conventional fluid pressurizing structure in FIG. 1.
Figure 3:
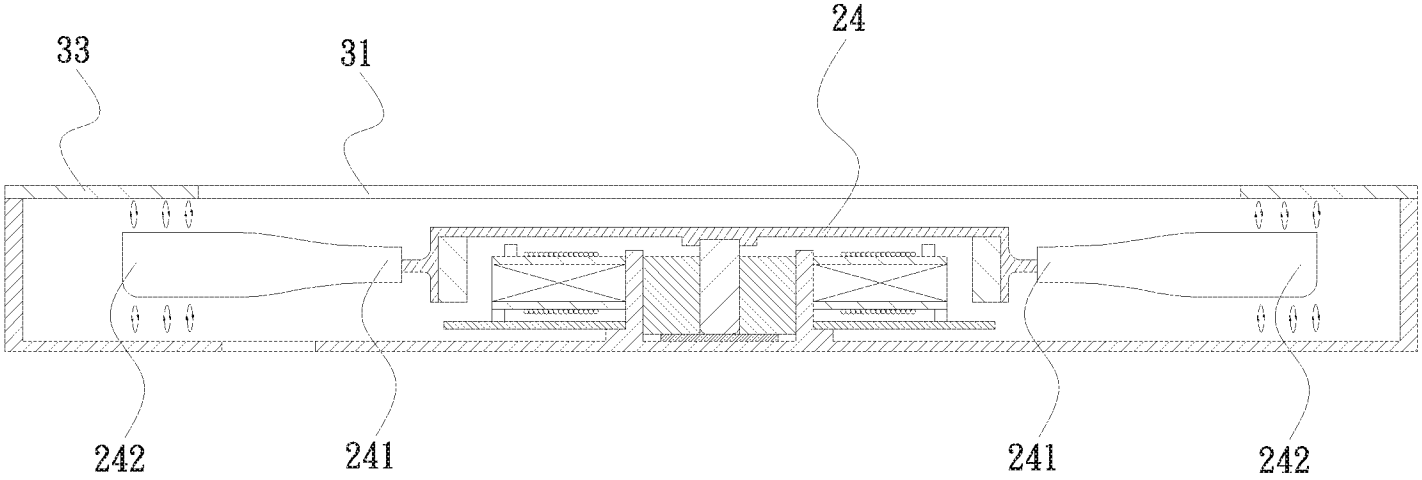
(PRIOR ART) Fig. 3
FIG. 3 is an assembled cross sectional view of the prior art fan frame and the conventional fluid pressure structure of FIG. 1.
Figure 4A:
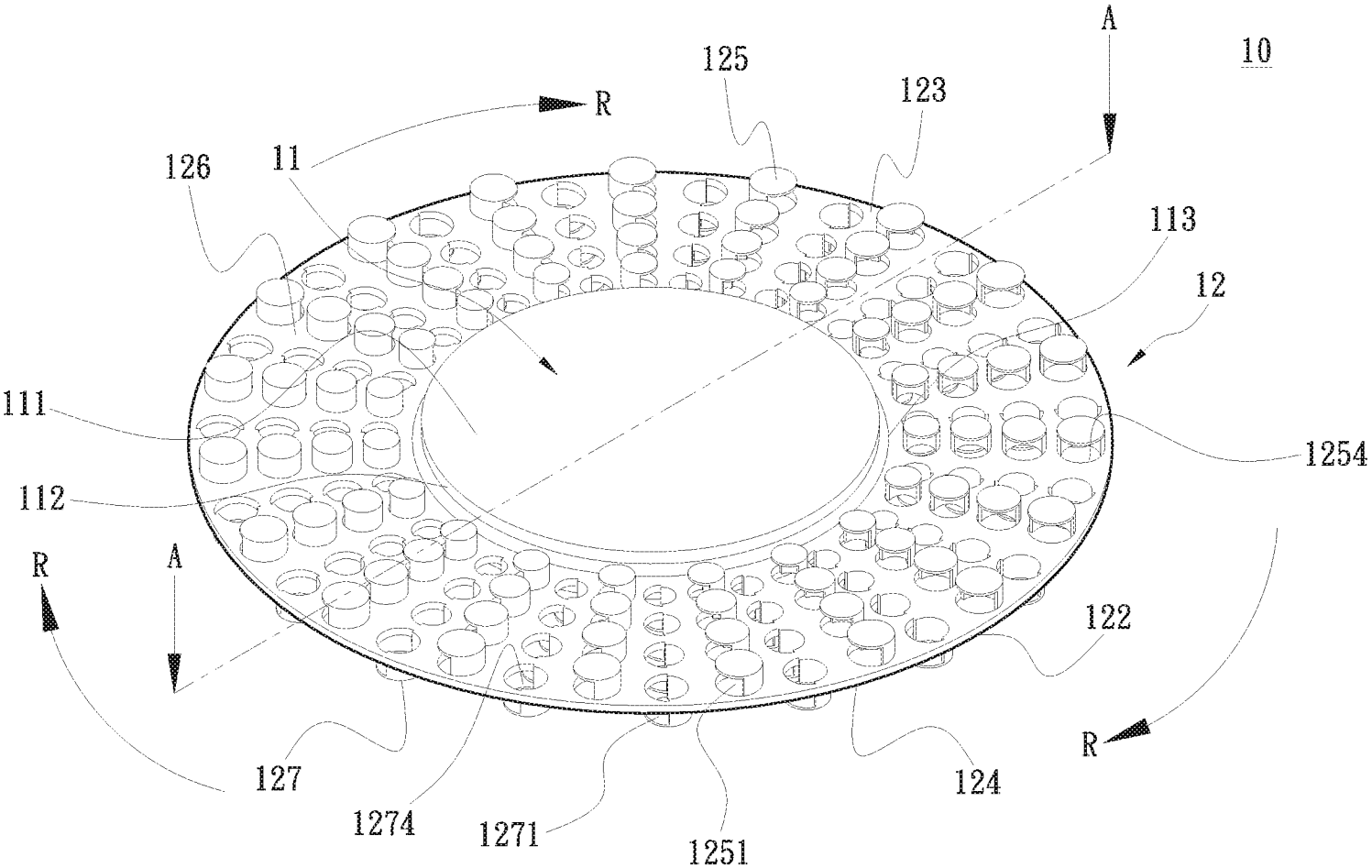
FIG. 4A is a perspective view of a fluid pressurizing structure according to a preferred embodiment of the present invention, which includes a plate portion and is provided at two opposite sides of the plate portion with a plurality of first and second hollow protrusions, respectively.
Figure 4B:
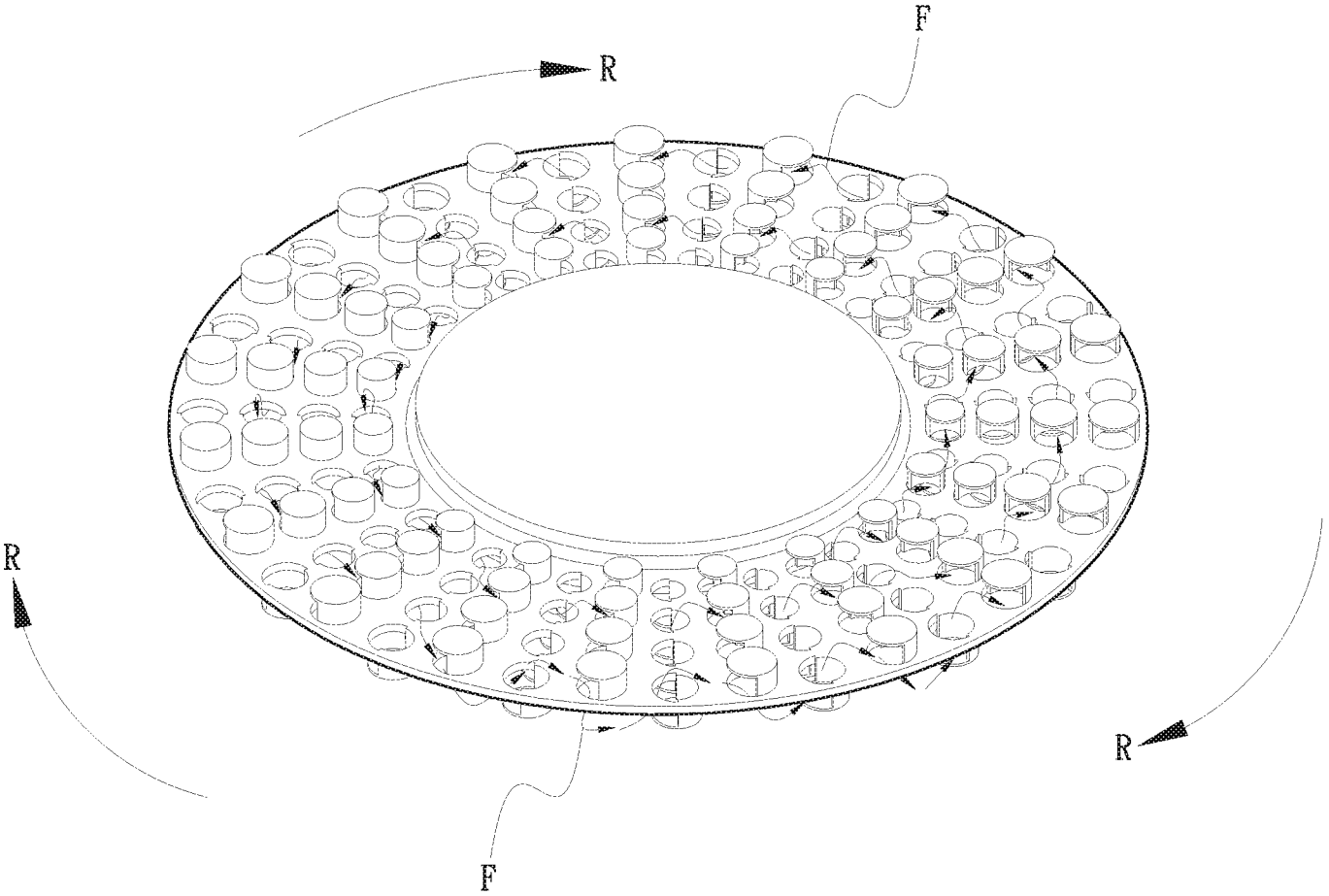
FIG. 4B shows the manner in which a fluid flows when the fluid pressuring structure of FIG. 4A rotates.
Figure 5A:
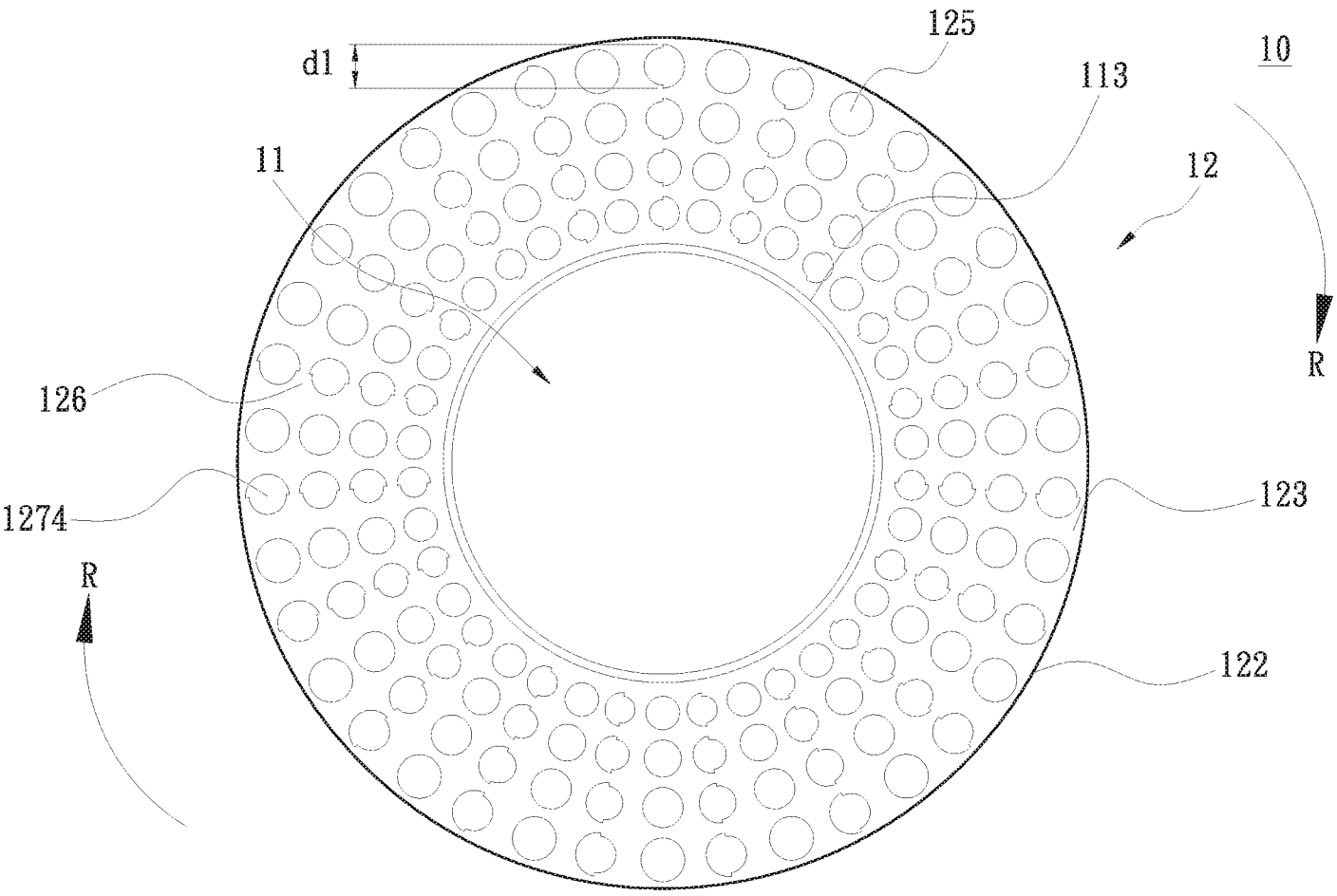
FIGS. 5A and 5B are top and bottom views, respectively, of the fluid pressuring structure of the present invention according to an example thereof.
Figure 5B:
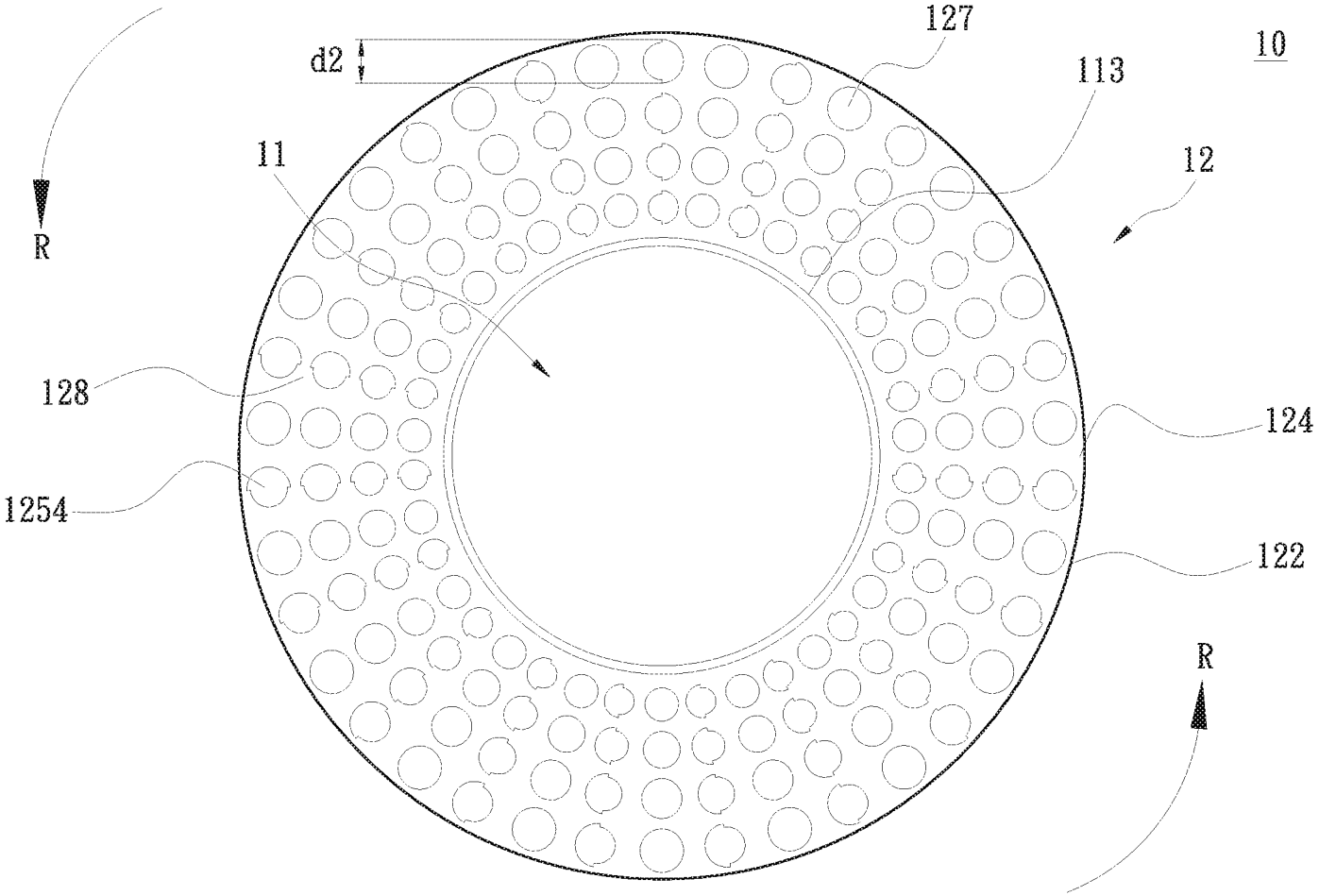

Please refer to FIGS. 4A, 4B, 5A and 5B, wherein FIG. 4A is a perspective view of a fluid pressurizing structure 10 according to a preferred embodiment of the present invention, FIG. 4B shows how a fluid flows when the fluid pressurizing structure 10 rotates, and FIGS. 5A and 5B are top and bottom views, respectively, of the fluid pressuring structure 10 according to an example thereof. As shown in FIG. 4A, the fluid pressuring structure 10 is rotatably in a rotational direction indicated by the arrow R, and includes a hub 11 and a plate portion 12. The hub 11 has a top 111, and a peripheral wall 112 vertically downward extended around a periphery of the top 111. An outer surface of the peripheral wall 112 defines an outer circumferential surface 113. While the top 111 in the illustrated preferred embodiment is a complete surface without any hole, a through hole can be otherwise formed thereon in other embodiments. The plate portion 12 can be, for example, an annular plate located around the hub 11 and has a free end 122. The plate portion 12 is connected to the hub 11 at the outer circumferential surface 113, at where a fluid-incoming side is defined. On the other hand, the free end 122 is radially outward extended in a direction opposite to the outer circumferential surface 113 of the hub 11 to define a fluid-outgoing side. Further, the plate portion 12 has an upper and a lower side that are defined as a first surface 123 and a second surface 124, respectively, which are located and radially extended between the outer circumferential surface 113 and the free end 122.

On the first surface 123, there are provided a plurality of short first hollow protrusions 125, such as short hollow columns or short hollow pins, each of which has a first fluid inlet 1251 and a first fluid outlet 1254. The first fluid outlet 1254 extends through the plate portion 12 in a thickness direction thereof to communicate the first fluid inlet 1251 with the second surface 124 of the plate portion 12. The first hollow protrusions 125 are so arrayed that they are spaced from one another with a first space 126 formed between any two adjacent first hollow protrusions 125 or around each of them. Similarly, on the second surface 124, there are provided a plurality of short second hollow protrusions 127, such as short hollow columns or short hollow pins, each of which has a second fluid inlet 1271 and a second fluid outlet 1274. The second fluid outlet 1274 extends through the plate portion 12 in a thickness direction thereof to communicate the second fluid inlet 1271 with the first surface 123 of the plate portion 12. The second hollow protrusions 127 are so arrayed that they are spaced from one another with a second space 128 formed between any two adjacent second hollow protrusions 127 or around each of them. Further, it is noted the first hollow protrusions 125 on the first surface 123 and the second hollow protrusions 127 on the second surface 124 are arrayed in a staggered arrangement, such that the plate portion 12 rotating clockwise would disturb a fluid F, such as a gas or a liquid, surrounding the plate portion 12, causing the fluid F to flow counterclockwise while the first and the second fluid inlets 1251, 1271 are brought to move clockwise along with the plate portion 12. On the other hand, the plate portion 12 rotating counterclockwise would disturb the fluid F surrounding it, causing the fluid F to flow clockwise while the first and the second fluid inlets 1251, 1271 are brought to move counterclockwise along with the plate portion 12.

When the plate portion rotates continuously, the fluid F keeps flowing through the first fluid inlets 1251, the first fluid outlet 1254, the second fluid inlets 1271 and the second fluid outlets 1274 sequentially in a helical movement in cycles. More specifically, the fluid F near the first surface 123 is drawn into the first hollow protrusions 125 via the first fluid inlets 1251 and then flows through the first fluid outlets 1254 to the second surface 124 of the plate portion 12. At this point, a change of angular momentum of the fluid F occurs. Thereafter, the fluid F at the second surface 124 is drawn into the second hollow protrusions 127 via the second fluid inlets 1271 and then flows through the second fluid outlets 1274 to the first surface 123 of the plate portion 12 again. At this point, another change of angular momentum of the fluid F occurs. When the plate portion 12 keeps rotating, the fluid F is repeatedly drawn into and drawn out of the first and the second hollow protrusions 125, 127 in cycles, the change of angular momentum of the fluid F also occurs in cycles. In this way, an increased length of effective fluid pressurizing section can be formed on the plate portion 12 and the fluid F can be continuously pressurized. With the arrangement of the present invention, the fluid F will always be drawn into a following first and the second hollow protrusions 125, 127 sequentially before it can form any fan frame impacting swirl. In other words, swirls of the fluid F possibly created in a fan are eliminated or reduced with the fluid pressuring structure 10 of the present invention, which not only facilitates reduced fan vibration and noise, but also avoids ineffective work done and high power consumed by fan motor. In FIG. 4B, to enable easy understanding of the present invention, the fluid F is shown to distribute over only some part of the plate portion 12. In actual operation of the present invention, the fluid F is distributed all over the first and second surfaces 123, 124, the first and second fluid inlets 1251, 1271, and the first and second fluid outlets 1254, 1274.

Please refer to FIGS. 6A to 6F, which show both the first and the second hollow protrusions 125, 127 can have the same or different axial heights. As shown, the first hollow protrusions 125 all have a first bottom end 1252 connected to the first surface 123 of the plate portion 12 and a first free end 1253 upward extended from the first bottom end 1252, such that a first axial height h1 is defined between the first bottom 1252 and the first free end 1253. Similarly, the second hollow protrusions 127 all have a second bottom end 1272 connected to the second surface 124 of the plate portion 12 and a second free end 1273 downward extended from the second bottom end 1272, such that a second axial height h2 is defined between the second bottom 1252 and the second free end 1273. In practical implementation of the present invention, the first and the second axial height h1, h2 can be changed according to actual need in use or to the exact configuration of a fan frame.

Figure 6A:
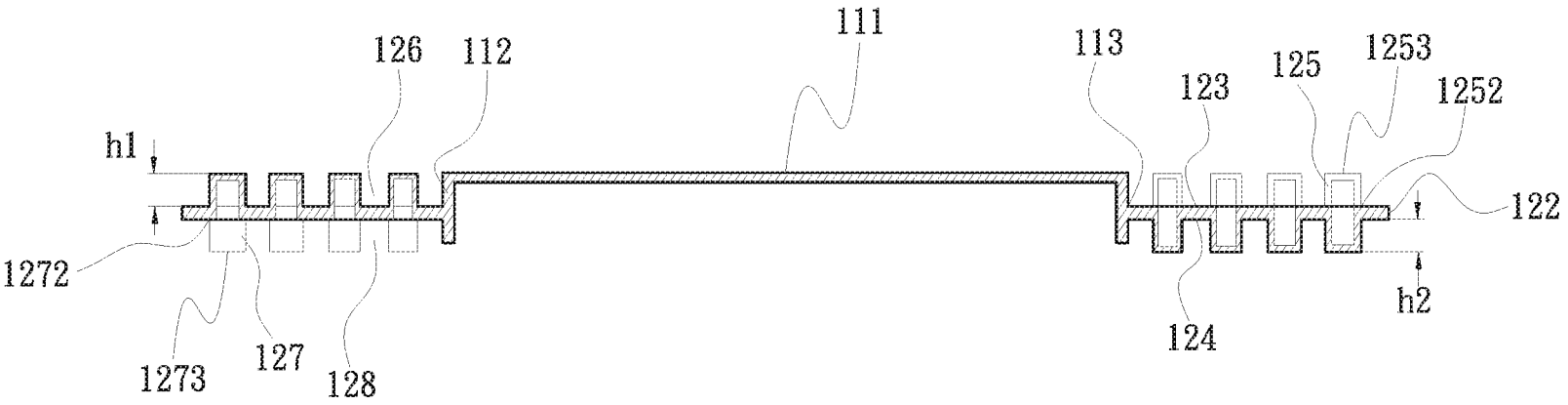
FIGS. 6A to 6G show both the first and the second hollow protrusions can have the same or different axial heights.
Figure 6B:
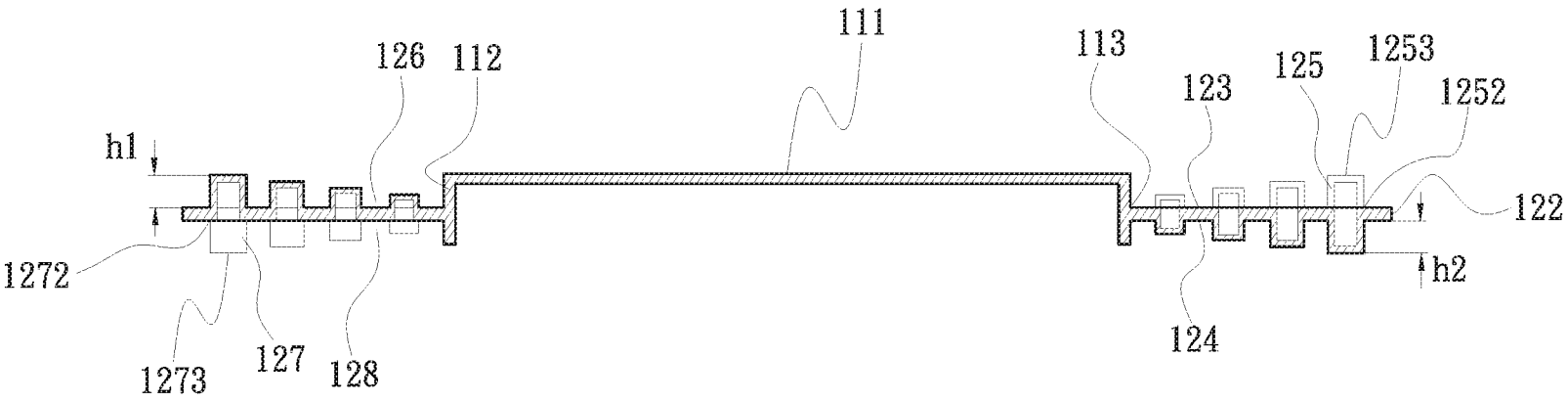
Figure 6C:
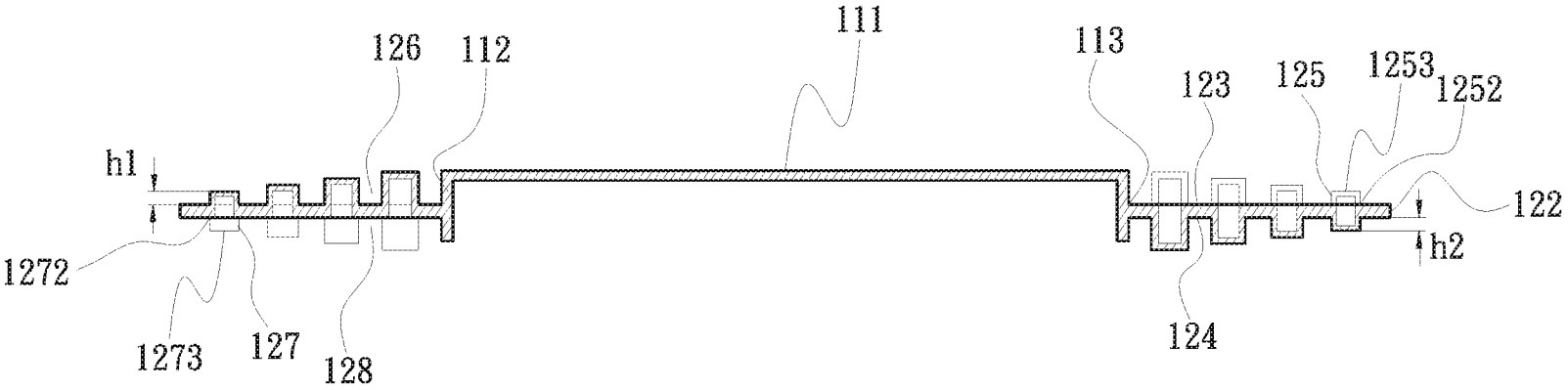

In a first example as shown in FIG. 6A, the first hollow protrusions 125 have the same first axial height h1, and the second hollow protrusions 127 have the same second axial height h2. In a second example as shown in FIG. 6B, the first and the second axial height h1, h2 of the first and the second hollow protrusions 125, 127, respectively, are gradually increased from the outer circumferential surface 113 toward the free end 122. In other word, in the second example shown in FIG. 6B, the first and the second axial height h1, h2 of the first and the second hollow protrusions 125, 127, respectively, located closer to the outer circumferential surface 113 are lower than that of those first and second hollow protrusions 125, 127 located closer to the free end 122. In a third example shown in FIG. 6C, the first and the second axial height h1, h2 of the first and the second hollow protrusions 125, 127, respectively, are gradually decreased from the outer circumferential surface 113 toward the free end 122. In other word, in the third example shown in FIG. 6C, the first and the second axial height h1, h2 of the first and the second hollow protrusions 125, 127, respectively, located closer to the outer circumferential surface 113 are higher than that of those first and second hollow protrusions 125, 127 located closer to the free end 122.

Figure 6D:
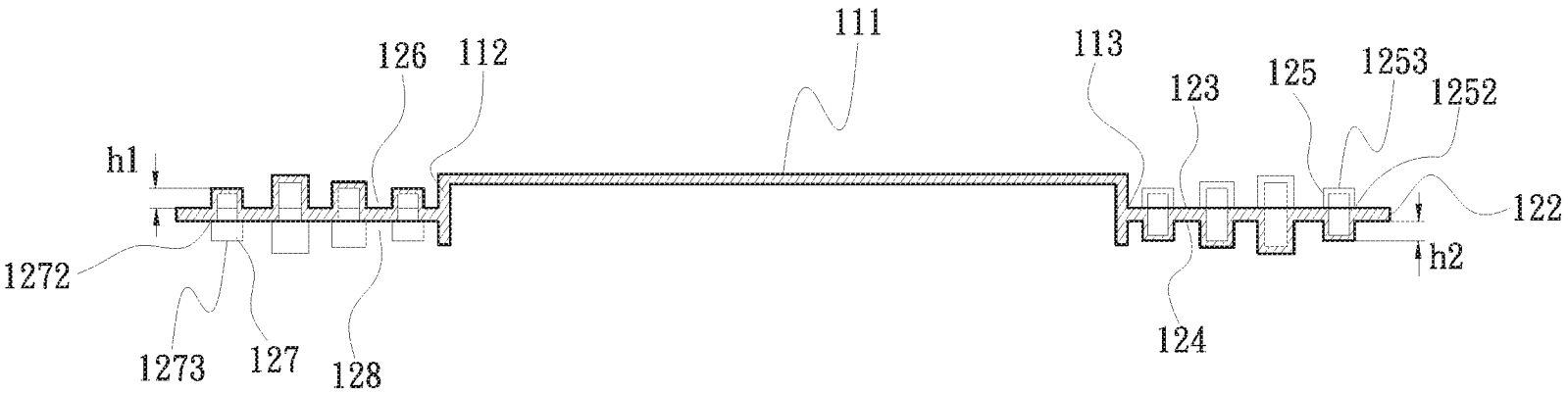
Figure 6E:
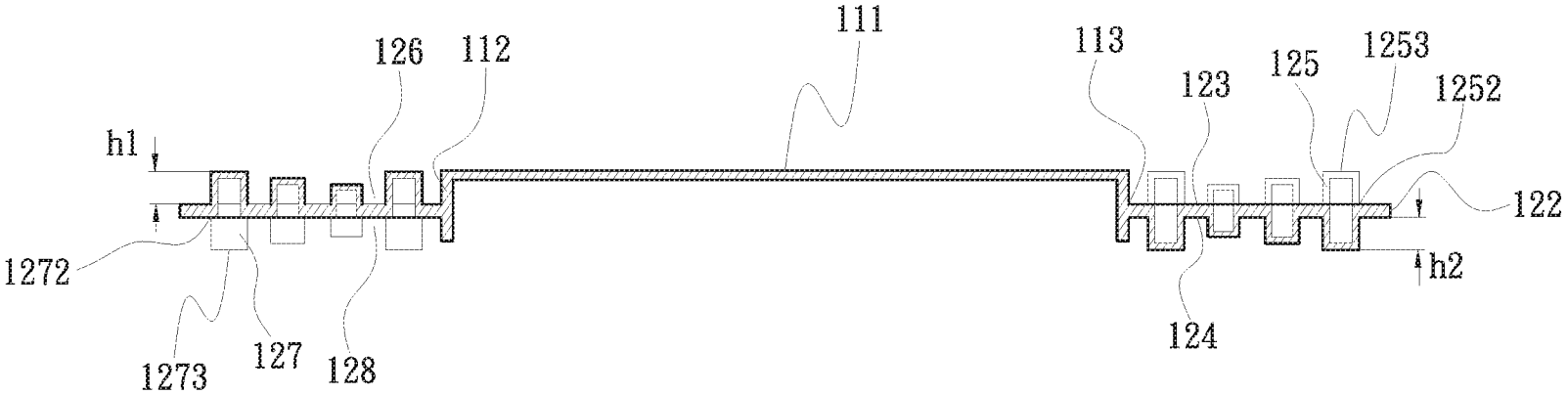

Or, in a fourth example as shown in FIG. 6D, the first and the second axial height h1, h2 of the first and the second hollow protrusions 125, 127, respectively, are first gradually increased and then gradually decreased again from the outer circumferential surface 113 toward the free end 122. In other word, in the fourth example shown in FIG. 6D, the first and the second axial height h1, h2 of the first and the second hollow protrusions 125, 127, respectively, located closer to the outer circumferential surface 113 and the free end 122 are lower than that of those first and second hollow protrusions 125, 127 located in the middle between the outer circumferential surface 113 and the free end 122. Or, in a fifth example as shown in FIG. 6E, the first and the second axial height h1, h2 of the first and the second hollow protrusions 125, 127, respectively, are first gradually decreased and then gradually increased again from the outer circumferential surface 113 toward the free end 122. In other word, in the fifth example shown in FIG. 6E, the first and the second axial height h1, h2 of the first and the second hollow protrusions 125, 127, respectively, located closer to the outer circumferential surface 113 and the free end 122 are higher than that of those first and second hollow protrusions 125, 127 located in the middle between the outer circumferential surface 113 and the free end 122.

Figure 6F:
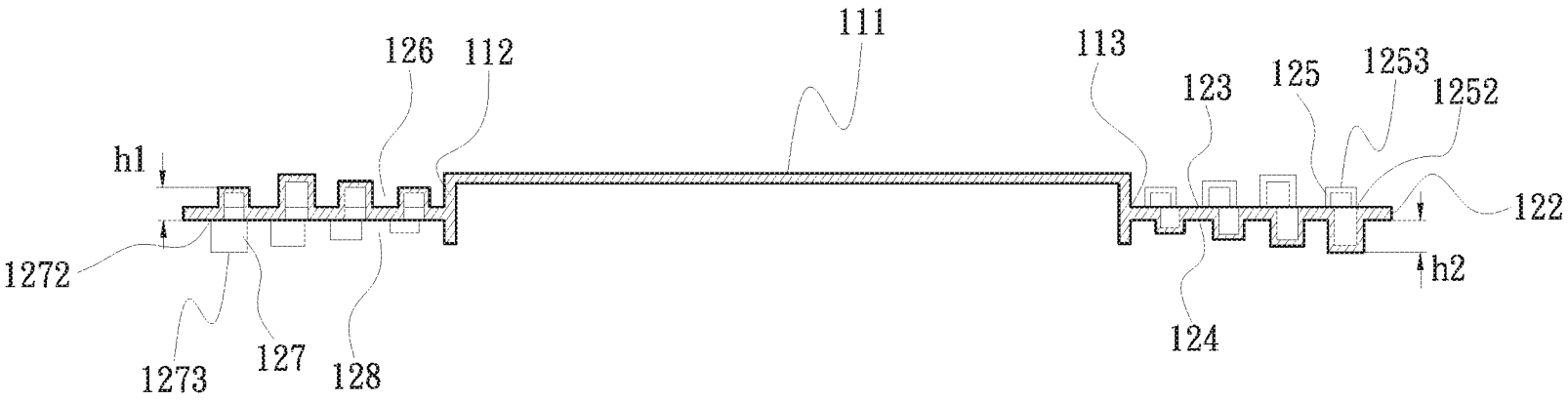
Figure 6G:
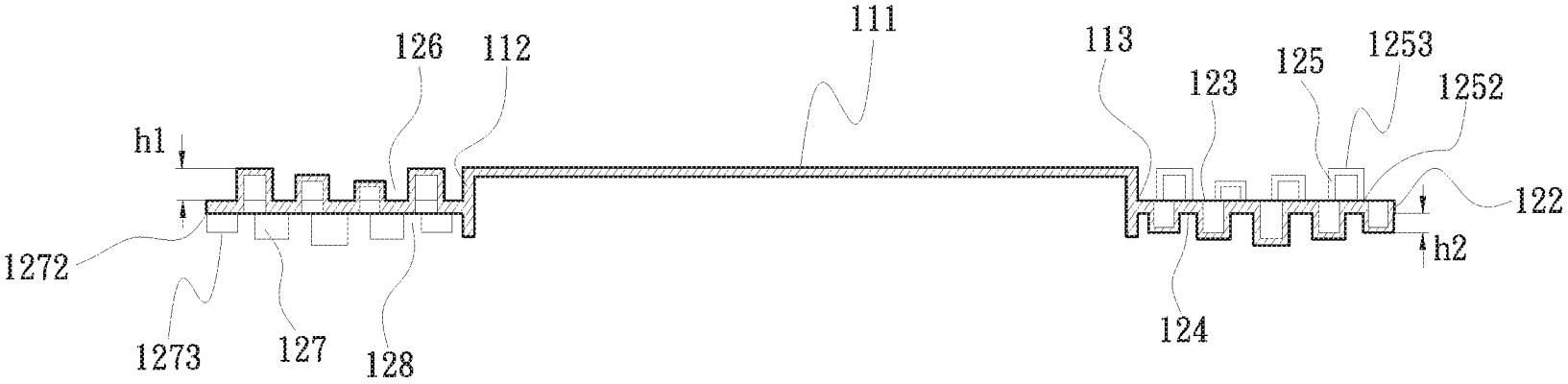

Alternatively, the first and the second axial height h1, h2 of the first and the second hollow protrusions 125, 127, respectively, can be the same as or different from one another from the outer circumferential surface 113 to the free end 122. In a non-restrictive sixth example as shown in FIG. 6F, the first axial height h1 of the first hollow protrusions 125 is gradually increased and then gradually decreased again from the outer circumferential surface 113 toward the free end 122, while the second axial height h2 of the second hollow protrusions 127 is gradually increased from the outer circumferential surface 113 toward the free end 122. In other examples, the first and the second axial height h1, h2 as well as the array of the first and the second hollow protrusions 125, 127 on the first and the second surface 123, 124, respectively, can be differently changed independent of one another. For instance, in a non-restrictive seventh example as shown in FIG. 6G, the first hollow protrusions 125 are equally spaced on the first surface 123 while the second hollow protrusions 127 are unequally spaced on the second surface 124. In other possible examples, both the first and the second hollow protrusions 125, 127 can be unequally spaced.

Figure 6H:
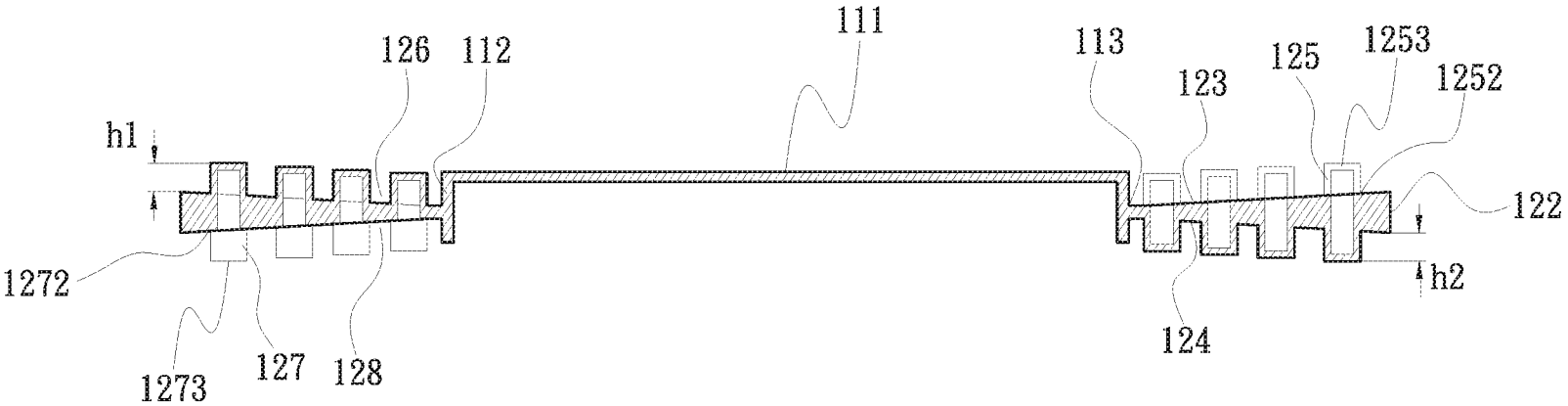
FIGS. 6H and 6I show the plate portion of the fluid pressurizing structure in FIG. 4A can have differently designed upper and lower surfaces.
Figure 6I:
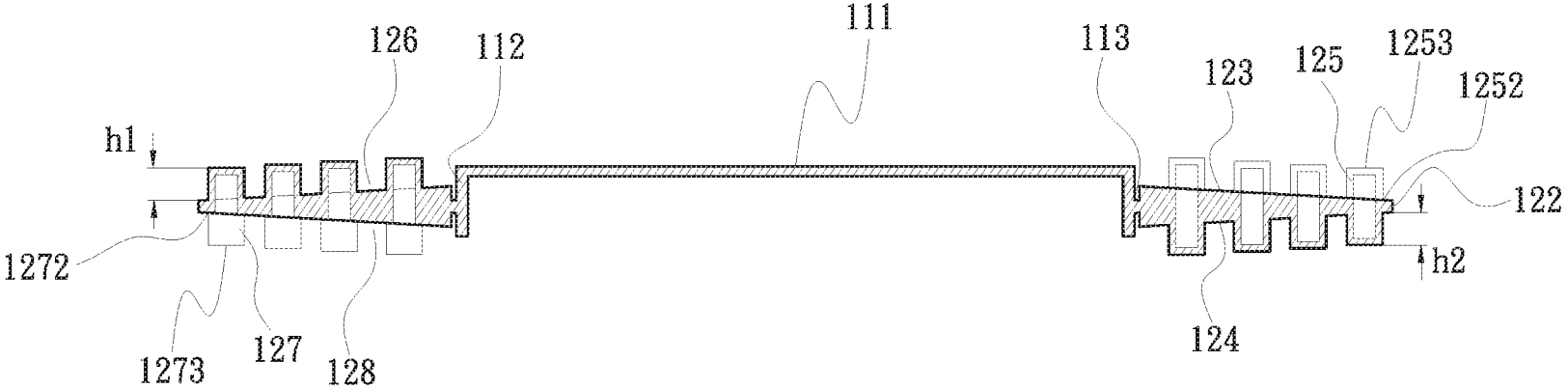

Further, in the previously illustrated figures, the plate portion 12 is a flat member having a uniformed thickness and horizontally extended first and second surface 123, 124. However, in other embodiments of the present invention, as shown in FIGS. 6H and 6I, the plate portion 12 many have non-horizontally extended first and second surface 123, 124. In FIG. 6H, the first and the second surface 123, 124 of the plate portion 12 are slanted surfaces to incline toward the hub 11. In this case, the first and the second hollow protrusions 125, 127 will gradually become higher in location from the outer circumferential surface 113 to the free end 122. On the other hand, in another embodiment as shown in FIG. 6I, the first and the second surface 123, 124 of the plate portion 12 are slanted surfaces to incline toward the free end 122 of the plate portion 12. In this case, the first and the second hollow protrusions 125, 127 will gradually become lower in location from the outer circumferential surface 113 to the free end 122. Please note, while the first and the second axial height h1, h2 of the first and the second hollow protrusions 125, 127, respectively, illustrated in FIGS. 6H and 6I are the same, it is understood they are not necessary to be the same all the time. The slanted first and second surfaces 123, 124 are also applicable to the plate portion 12 having first and second hollow protrusions 125, 127 with different or variable first and second axial height h1, h2.

Please refer to FIGS. 5A and 5B again. The first and the second hollow protrusions 125, 127 have a first and a second outer diameter (OD) d1, d2, respectively. The first OD d1 of each first hollow protrusion 125 is a straight distance defined between any two diametrically opposite points of tangency on the first hollow protrusion 125. Similarly, the second OD d2 of each second hollow protrusion 127 is a straight distance defined between any two diametrically opposite points of tangency on the second hollow protrusion 127. In FIGS. 5A and 5B, the first and the second OD d1, d2 are illustrated as being variable. However, in other embodiments, the first and the second OD d1, d2 can be the same as each other. In the embodiment shown in FIGS. 5A and 5B, both of the first and the second OD d1, d2 of the first and the second hollow protrusions 125, 127, respectively, are gradually increased from the outer circumferential surface 113 toward the free end 122. In other words, the first and the second OD d1, d2 of the first and the second hollow protrusions 125, 127 located closer to the free end 122 are larger than the first and the second OD d1, d2 of the first and the second hollow protrusions 125, 127 located closer to the outer circumferential surface 113. However, in other operable embodiments of the present invention, the first and the second OD d1, d2 can be gradually decreased from the outer circumferential surface 113 toward the free end 122. In other words, the first and the second OD d1, d2 of the first and the second hollow protrusions 125, 127 located closer to the outer circumferential surface 113 are larger than the first and the second OD d1, d2 of the first and the second hollow protrusions 125, 127 located closer to the free end 122.

Figure 7A:
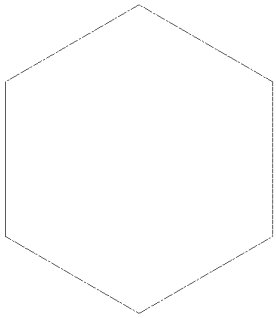
FIGS. 7A to 7C show some cross sectional geometric shapes that can be adopted for the first and second hollow protrusions.
Figure 7B:
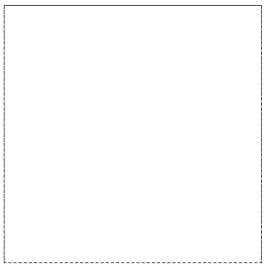
Figure 7C:
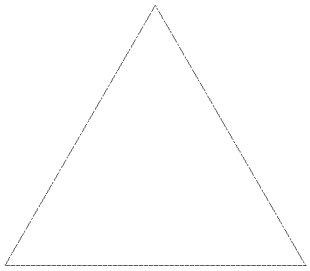

FIGS. 7A to 7C show some cross sections of different geometric shapes that can also be adopted for the first and second hollow protrusions 125, 127. Please refer to FIGS. 5A and 5B. The first and the second hollow protrusion 125, 127 respectively have a cross-sectional shape that is defined by a plane extending parallel to the plate portion 12 and can be of any geometrical shape. While the first and the second hollow protrusions 125, 127 in FIGS. 5A and 5B have a round cross-sectional shape and look like a plurality of hollow cylinders, it is understood the cross-sectional shape can be differently designed in other embodiments. For example, the cross-sectional shape of the first and the second protrusions 125, 127 can be otherwise hexagonal, square or triangular, as sequentially shown in FIGS. 7A, 7B and 7C, or be any other shape. Further, in some embodiments, the first protrusions 125 on the first surface 123 and/or the second hollow protrusions 127 on the second surface 124 of the plate portion 12 can be different in their cross-sectional shapes. For example, it is possible for some of the first and second hollow protrusions 125, 127 to have a quasi-circular cross-sectional shape, while others have a triangular and/or a square cross-sectional shape.

Figure 8A:
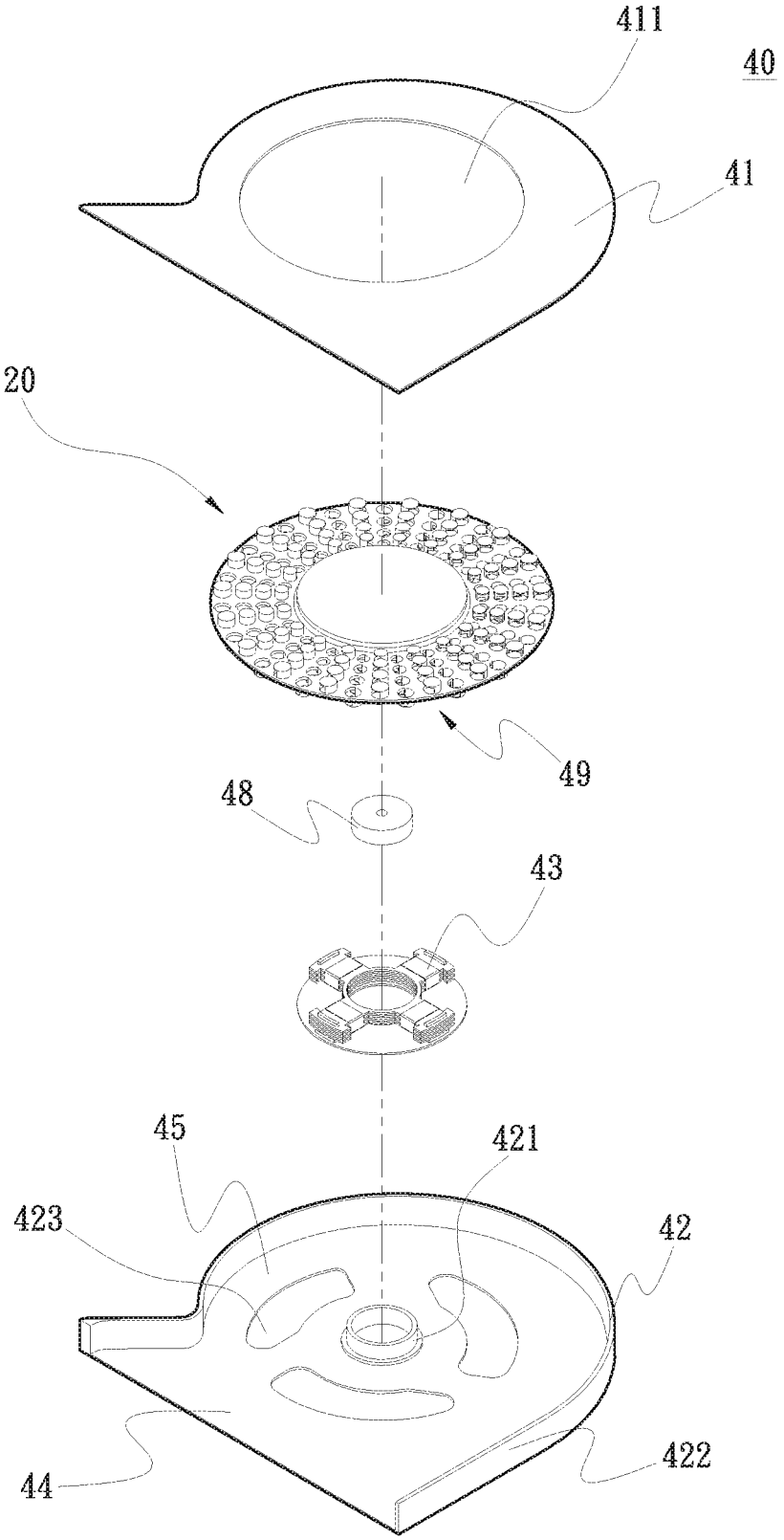
FIG. 8A is an exploded perspective view of a fan using the fluid pressurizing structure of the present invention.
Figure 8B:
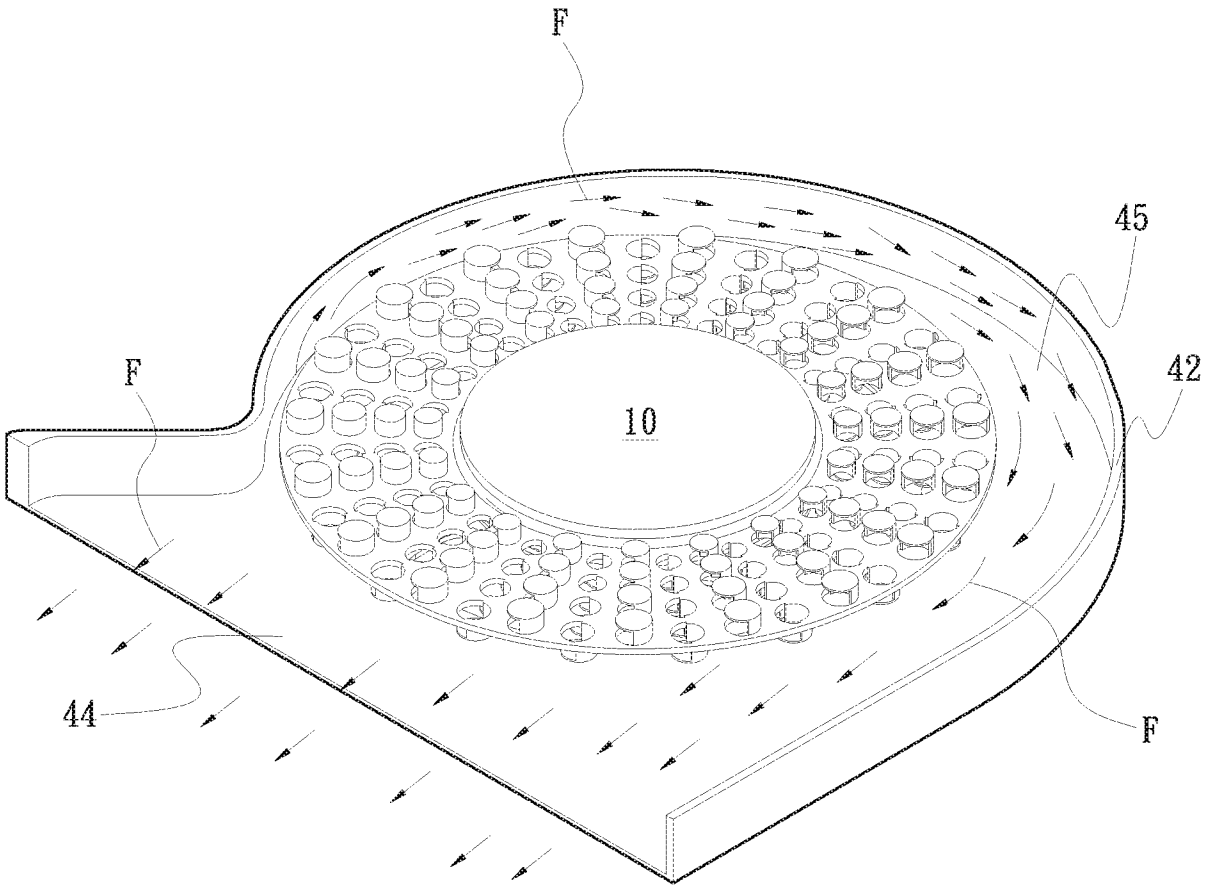
FIG. 8B is a perspective view showing the manner in which a fluid is pressurized while it flows through the fan of FIG. 8A.

FIG. 8A is an exploded perspective view of a fan using the fluid pressurizing structure 10 of the present invention; and FIG. 8B is a perspective view showing the manner in which a fluid F is pressurized while it flows through the fan of FIG. 8A. As shown in FIG. 8A, the fan is in the form of a fan frame 40 formed of a top cover 41 and a frame body 42. It is also noted the top cover 41 is omitted from FIG. 8B to enable easy understanding of the present invention. The top cover 41 of the fan frame 40 has an inlet opening 411, and the frame body 42 includes a coupling seat 421 and a sidewall 422. The top cover 41 and the frame body 42 together define a sideward outlet opening 44 and a fluid passage 45 between them. The coupling seat 421 has a stator assembly 43 disposed therearound, and is optionally externally surrounded by a plurality of through holes 423 formed on the frame body 42. As shown in FIG. 8A, the sidewall 422 is upward vertically extended along the frame body 42 to connect the top cover 41 thereto; and the fluid passage 45 is communicable with the sideward outlet opening 44.

The coupling seat 421 has at least one bearing 48 received therein for a shaft (not shown) provided on the top 111 of the hub 11 to connect thereto, so that the fluid pressurizing structure 10 is supported on and held to the coupling seat 421. The peripheral wall 112 of the hub 11 has a rotor assembly (including an iron case and magnets) 49 mounted thereon and located corresponding to the stator assembly 43. The top 111 of the hub 11 is located corresponding to the inlet opening 411 on the fan frame 40. The inlet opening 411 has a diameter that can be for example larger than a diameter of the top 111 of the hub 11 without being limited thereto. The second hollow protrusions 127 are located corresponding to the through openings 423 on the frame body 42. Please refer to FIGS. 8A and 8B at the same time. When the fluid pressurizing structure 10 rotates, fluid F surrounding the fan frame 40 is disturbed and drawn into the fan frame 40 via the inlet opening 411 to flow to the outer circumferential surface 113 of the hub 11 (or the fluid-incoming side) of the fluid pressurizing structure 10. The fluid pressurizing structure 10 enables the fluid F flowed thereto to keep flowing in the aforesaid fluid helical movement and be pressurized. Since external fluid is continuously drawn into the fan frame 40 while the fluid F keeps flowing at the plate portion 12 and being continuously pressurized, the fluid F at the plate portion 12 has an increasingly grown pressure compared to the pressure in the fluid passage 45. The fluid F having higher fluid pressure naturally flows toward the fluid passage 45 that have lower fluid pressure, and then finally flows out of fan frame 40 via the sideward outlet opening 44. Further, when the fluid pressurizing structure 10 rotates, it also drives the fluid F to flow through the through holes 423 to the outer circumferential surface 113 of the hub 11 (the fluid-incoming side. The fluid F then keeps flowing through the second hollow protrusions 127 and the second spaces 128 to the free end 122 of the plate portion 12 (or the fluid-outgoing side), from where the fluid F flows into the fluid passage 45 and finally flows out of the fan frame 40 via the sideward outlet opening 44.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fluid pressurizing structure, comprising:

a hub having an outer circumferential surface; and a plate portion being located around the hub and connected thereto at the outer circumferential surface; the plate portion having a first surface provided with a plurality of first hollow protrusions, an opposite second surface provided with a plurality of second hollow protrusions, and a free end; the first and the second hollow protrusions on the first and the second surface being arrayed in a staggered arrangement; each of the first hollow protrusions having a first fluid inlet and a first fluid outlet, and each of the second hollow protrusions having a second fluid inlet and a second fluid outlet; the first fluid outlet extending through the plate portion in a thickness direction thereof to communicate the first fluid inlet with the second surface, and the second fluid outlet extending through the plate portion in the thickness direction thereof to communicate the second fluid inlet with the first surface.

2. The fluid pressurizing structure as claimed in claim 1, wherein the plate portion is capable of rotating clockwise to disturb a fluid and cause the fluid to flow counterclockwise while the first and the second fluid inlets are brought to move clockwise along with the plate portion.

3. The fluid pressurizing structure as claimed in claim 1, wherein the first and the second hollow protrusions arrayed on the first and the second surface, respectively, are either equally or unequally spaced from one another.

4. The fluid pressurizing structure as claimed in claim 1, wherein each of the first hollow protrusions has a first bottom end and a first free end, between which a first axial height is defined.

5. The fluid pressurizing structure as claimed in claim 1, wherein the each of the second hollow protrusions has a second bottom end and a second free end, between which a second axial height is defined.

6. The fluid pressurizing structure as claimed in claim 4, wherein the first hollow protrusions have different first axial heights, which are either gradually increased or gradually decreased in a direction from the outer circumferential surface of the hub toward the free end of the plate portion.

7. The fluid pressurizing structure as claimed in claim 5, wherein the second hollow protrusions have different second axial heights, which are either gradually increased or gradually decreased in a direction from the outer circumferential surface of the hub toward the free end of the plate portion.

8. The fluid pressurizing structure as claimed in claim 4, wherein the first hollow protrusions have different first axial heights, which are either gradually increased and then gradually decreased or gradually decreased and then gradually increased in a direction from the outer circumferential surface of the hub toward the free end of the plate portion.

9. The fluid pressurizing structure as claimed in claim 5, wherein the second hollow protrusions have different second axial heights, which are either gradually increased and then gradually decreased or gradually decreased and then gradually increased in a direction from the outer circumferential surface of the hub toward the free end of the plate portion.

10. The fluid pressurizing structure as claimed in claim 1, wherein the first hollow protrusions respectively have a cross-sectional shape defined by a plane extending parallel to the plate portion.

11. The fluid pressurizing structure as claimed in claim 1, wherein the second hollow protrusions respectively have a cross-sectional shape defined by a plane extending parallel to the plate portion.

12. The fluid pressurizing structure as claimed in claim 10, wherein the cross-sectional shape is selected from the group consisting of a quasi-circular, a hexagonal, a square, ora triangular shape.

13. The fluid pressurizing structure as claimed in claim 11, wherein the cross-sectional shape is selected from the group consisting of a quasi-circular, a hexagonal, a square, or a triangular, shape.

14. The fluid pressurizing structure as claimed in claim 1, wherein the first hollow protrusions on the first surface and the second hollow protrusions on the second surface of the plate portion can be arrayed in the same way or in different ways.

15. The fluid pressurizing structure as claimed in claim 1, wherein each of the first hollow protrusions has a first outer diameter (OD), and the first OD can be the same or different among the first hollow protrusions.

16. The fluid pressurizing structure as claimed in claim 1, wherein each of the second hollow protrusions has a second outer diameter (OD), and the second OD can be the same or different among the second hollow protrusions.

17. The fluid pressurizing structure as claimed in claim 14, wherein the first hollow protrusions have different first ODs, which are either gradually increased or gradually decreased in a direction from the outer circumferential surface of the hub toward the free end of the plate portion.

18. The fluid pressurizing structure as claimed in claim 15, wherein the second hollow protrusions have different second ODs, which are either gradually increased or gradually decreased in a direction from the outer circumferential surface of the hub toward the free end of the plate portion.

19. The fluid pressurizing structure as claimed in claim 1, wherein the outer circumferential surface of the hub defines a fluid-incoming side and the free end of the plate portion defines a fluid-outgoing side, and the first surface of the plate portion can be selected from the group consisting of a horizontally extended surface and a slanted surface.

20. A fan with fluid pressurizing structure, comprising:

a fan frame formed of a top cover and a frame body; the top cover having an inlet opening and the frame body including a coupling seat and a sidewall; the top cover and the frame body together defining a sideward outlet opening and a fluid passage between them; the coupling seat having a stator assembly disposed therearound and being externally surrounded by a plurality of through holes formed on the frame body; the sidewall being located around the fluid passage and upward vertically extended to connect the frame body to the top cover, and the fluid passage being communicable with the sideward outlet opening; and a fluid pressurizing structure including:

a hub having a top and a peripheral wall; the top being located corresponding to the inlet opening on the top cover of the fan frame and having a shaft connected to at least one bearing received in the coupling seat on the fan frame; the peripheral wall being vertically downward extended around a periphery of the top and having a rotor assembly mounted thereon and located corresponding to the stator assembly; and an outer surface of the peripheral wall defining an outer circumferential surface; and a plate portion being located around the hub and connected thereto at the outer circumferential surface; the plate portion having a first surface provided with a plurality of first hollow protrusions, an opposite second surface provided with a plurality of second hollow protrusions, and a free end; the first and the second hollow protrusions on the first and the second surface being arrayed in a staggered arrangement; each of the first hollow protrusions having a first fluid inlet and a first fluid outlet, and each of the second hollow protrusions having a second fluid inlet and a second fluid outlet; the first fluid outlet extending through the plate portion in a thickness direction thereof to communicate the first fluid inlet with the second surface, and the second fluid outlet extending through the plate portion in the thickness direction thereof to communicate the second fluid inlet with the first surface.

* * * * *